US008319589B2

(12) United States Patent
Hammond

(10) Patent No.: US 8,319,589 B2
(45) Date of Patent: Nov. 27, 2012

(54) POSITION SENSOR FOR MECHANICALLY LATCHING SOLENOID

(75) Inventor: Peter Willard Hammond, Greensburg, PA (US)

(73) Assignee: Siemens Industry, Inc., Alpharetta, GA (US)

( * ) Notice: Subject to any disclaimer, the term of this patent is extended or adjusted under 35 U.S.C. 154(b) by 375 days.

(21) Appl. No.: 12/622,807

(22) Filed: Nov. 20, 2009

(65) Prior Publication Data

US 2010/0127807 A1 May 27, 2010

Related U.S. Application Data

(60) Provisional application No. 61/117,819, filed on Nov. 25, 2008.

(51) Int. Cl.
*H01F 1/00* (2006.01)

(52) U.S. Cl. ..... 335/219; 335/207

(58) Field of Classification Search ..... 335/219
See application file for complete search history.

(56) References Cited

U.S. PATENT DOCUMENTS

| | | | | |
|---|---|---|---|---|
| 3,022,450 | A | 2/1962 | Chase, Jr. | |
| 7,602,271 | B2 * | 10/2009 | York et al. | 335/279 |
| 7,800,254 | B2 * | 9/2010 | Hammond | 307/140 |
| 8,008,923 | B2 * | 8/2011 | Hammond | 324/426 |
| 2006/0130785 | A1 * | 6/2006 | Han et al. | 123/90.11 |
| 2007/0167741 | A1 * | 7/2007 | Sherman et al. | 600/424 |
| 2007/0271915 | A1 | 11/2007 | Stephen | |
| 2008/0042791 | A1 | 2/2008 | Pinkos | |
| 2008/0079314 | A1 * | 4/2008 | Hammond | 307/43 |
| 2008/0081244 | A1 * | 4/2008 | Hammond | 429/61 |
| 2008/0197949 | A1 * | 8/2008 | Lurquin et al. | 335/229 |

FOREIGN PATENT DOCUMENTS

WO WO 2007134287 A1 11/2007

* cited by examiner

*Primary Examiner* — Elvin G Enad
*Assistant Examiner* — Lisa Homza

(57) ABSTRACT

A magnetically latching solenoid and method of determining a position of a plunger contained therein. The solenoid includes a frame, a plunger configured to move through the frame between a first stable position and a second stable position, and at least one magnet mounted near the center of the frame such that a first and second magnetic fields are produced by the magnet through the frame and the plunger, wherein each of the first and second magnetic fields drive a separate portion of the frame into magnetic saturation depending on the position of the plunger. The solenoid also includes a first and second sensors mounted on the frame at different locations configured to detect and measure the first and second magnetic fields. The detected and measured magnetic fields are then used to determine the position of the plunger in the solenoid.

11 Claims, 9 Drawing Sheets

POSITION SENSOR FOR MECHANICALLY LATCHING SOLENOID

RELATED APPLICATION AND CLAIM OF PRIORITY

This application claims the priority of U.S. Provisional Application No. 61/117,819, filed Nov. 24, 2008, which is hereby incorporated by reference in its entirety.

Not Applicable

BACKGROUND

This document relates to a magnetically latching solenoid, and more particularly, to a position sensor for detecting the position of a plunger in a magnetically latching solenoid.

A magnetically latching solenoid has an advantage over conventional solenoids in that no control power is required to maintain a plunger of a magnetically latching solenoid in either of two possible stable positions. Magnetically latching solenoids are described in detail in U.S. Pat. No. 3,022,450 to Chase. By contrast, the plunger of a conventional non-latching solenoid is held by a spring in a first position when no current is applied to coil in the solenoid, and is driven to a second position by magnetic forces whenever sufficient current is applied to the coil. Such current must be continuously maintained as long as it is desired for the solenoid plunger to occupy the second position.

FIGS. 1-3 illustrate a magnetically latching solenoid, such as those described in the U.S. Pat. No. 3,022,450. It should be noted that the solenoid illustrated in FIGS. 1-3 has a box frame with open sides rather than the closed tubular frame shown in the U.S. Pat. No. 3,022,450. It should be noted that the position sensor disclosed in this document will work with either type of frame.

In FIG. 1, magnetically latching solenoid 100 may include a nonmagnetic shaft 102 that projects out of the frame 104 at one or both of opposing sides 105A and 105B. One purpose of the shaft 102 may be to guide and support the internal moving components of the solenoid 100. The shaft 102 also can be attached to external components (not shown), so that the external components can be caused to move by the solenoid 100. Solenoid 100 also includes two coils 106 inside the frame 104, and a permanent magnet structure including two magnets 108 between the coils 106.

FIG. 2A shows solenoid 100 with both coils 106 made invisible for added clarity. With coils 106 invisible, additional components of solenoid 100 may be seen. Cylindrical steel anvils 110A and 110B are attached to the inside surface of the left and right end of the frame 104. In this example, anvil 110A is attached to the left side 105A of solenoid 100 and anvil 110B is attached to the right sides 105B. Between the anvils 110A and 110B is a cylindrical steel plunger 112, which may be attached to the shaft 102 so that the plunger and the shaft can both slide left or right together, thus moving the shaft through an opening in one or both anvils until the plunger strikes one of the anvils. This motion of the plunger 112 and of the shaft 102 together is called the stroke of the solenoid 100. In FIG. 2 the plunger 112 and the shaft 102 are at the left end of their stroke.

With coils 106 made invisible, FIG. 2A also shows that the outer surfaces of the magnets 108 make contact with the inside surfaces of the top and the bottom of the frame 104, and that the inner surfaces of the permanent magnets make contact with coupler 114. The coupler 114 may be made from a magnetic material (such as steel) and has a large hole through which the plunger 112 passes, with a small clearance so that the coupler does not touch the plunger. One purpose of the coupler 114 is to conduct the magnetic flux from the magnets 108 into the plunger 112, thereby facilitating the latching of the plunger 112, and thus, the shaft 102, at either end of its stroke. An alternative construction may avoid the coupler 114 by vertically extending the magnets 108 toward a centerplane of the solenoid 100. Semicircular notches may be added to the extended magnets 108 such that the magnets deliver any magnetic flux directly to the plunger 112 across a small air gap.

Similar to FIG. 2A, FIG. 2B shows solenoid 100 with frame 104 and coils 106 made invisible.

FIG. 3 shows the same components as FIG. 2B, but with the anvils 110A and 110B made invisible, and viewed from the right end. FIG. 3 also shows that both magnets 108 are oriented so that their north poles are in contact with the coupler 114, and their south poles are in contact with the frame 104 (not shown in FIG. 3). The solenoid 100 would also work as well if the poles of both magnets 108 were reversed. The arrows represent the magnetic flux inside the magnets 108, the steel coupler 114, or the steel plunger 112. In this example, both magnets 108 drive magnetic flux into the coupler 114, from which the magnetic flux crosses the clearance gap 120 into the plunger 112. In an alternative construction with notched magnets such as the embodiment illustrated in FIG. 3A, the magnets 108 may direct magnetic flux directly across the gap 120 into plunger 112.

A magnetically latching solenoid latches because most of the magnetic flux tends to follow the path of least reluctance, which is the path that includes the largest portion in a high permeability material such as steel, and the least portion in air. When the plunger is at or near one end of its stroke, most of the flux from the magnets tends to pass through the shorter air gap, with very little passing through the longer air gap at the other end of the plunger.

The attractive forces produced on the flat ends of the plunger 112 are proportional to the square of the magnetic flux density there. Therefore, the attractive force across the shorter air gap will be much greater than the attractive force across the longer air gap. The difference between these forces will tend to hold or latch the plunger at the end of its stroke, without any current in the coil or coils.

A magnetically latching solenoid may be caused to change position by energizing one or both coils with a polarity such that the flux from the coil surrounding the shorter air gap tends to oppose the flux created in the shorter air gap by the magnets. When the attractive force in the shorter air gap becomes weak enough, the attractive force in the longer air gap may overcome it and cause the plunger to move. Once the plunger nears the opposite end of its stroke, the opposite air gap will become the shorter one, and the solenoid will latch in its new position.

The magnets 108 have a characteristic maximum flux density, which depends on the material from which the magnets are made. For example, Neodymium-Iron-Boron magnets have a maximum flux density of about 1.2 Tesla. By comparison, steel is capable of conducting a flux density of about 2.0 Tesla before it saturates.

To obtain large latching forces it is desirable to maximize the flux density at the flat ends of the plunger 112. The magnets 108 may be chosen to have a cross-sectional area larger than the cross-sectional area of the plunger 112. When the coupler 114 conducts the magnetic flux from the magnets 108 into the plunger 112, the magnetic flux is concentrated into a smaller cross-sectional area, and the flux density in the plunger is thereby increased over the flux density in the magnets, thereby increasing the latching forces that may be produced on the plunger. The maximum possible latching forces may be achieved when the plunger 112 reaches a flux density where its steel is saturated.

With a conventional solenoid it is possible to deduce the position of the plunger of the solenoid by detecting the presence or absence of sufficient current in the solenoid coil. This method is not feasible with a magnetically latching solenoid because the plunger may occupy either position when the coils are not energized. Therefore it is generally necessary to add extra components to a magnetically latching solenoid for the purpose of detecting the plunger position. Such extra components could include a micro-switch mounted on the stationary portion of the solenoid, with an actuator mounted on the moving portion of the solenoid. Depending on the position of the plunger, and thus the actuator, the switch would indicate whether the plunger is in a first or second position. Other possible extra components could include an optical sensor or a magnetic proximity sensor, but all share the drawback that an extra moving component is required, which decreases the reliability of the solenoid. For the case of a micro-switch, reliability is further decreased because the electrical contacts inside the micro-switch may become contaminated or corroded.

SUMMARY OF THE INVENTION

The invention described in this document is not limited to the particular systems, methodologies or protocols described, as these may vary. The terminology used herein is for the purpose of describing particular embodiments only, and is not intended to limit the scope of the present disclosure.

It must be noted that as used herein and in the appended claims, the singular forms "a," "an," and "the" include plural reference unless the context clearly dictates otherwise. Unless defined otherwise, all technical and scientific terms used herein have the same meanings as commonly understood by one of ordinary skill in the art. As used herein, the term "comprising" means "including, but not limited to."

In one general respect, the embodiments disclose a magnetically latching solenoid. The solenoid includes a frame, a plunger configured to move through the frame between a first stable position and a second stable position, at least one magnet mounted on the frame configured to produce a magnetic field through the plunger and the frame, wherein the magnetic field varies throughout the frame based upon the position of the plunger, and at least one sensor mounted to the frame configured to detect and measure the magnetic field at a selected location.

In another general respect, the embodiments disclose a magnetically latching solenoid. The solenoid includes a frame, a plunger configured to move through the frame between a first stable position and a second stable position, at least one magnet mounted near the center of the frame such that a first magnetic field and a second magnetic field are produced by the magnet through the frame and the plunger, wherein each of the first and second magnetic fields drive a separate portion of the frame into magnetic saturation depending on the position of the plunger, a first sensor mounted on the frame at a first location configured to detect and measure the first magnetic field at the first location of the frame, and a second sensor mounted on the frame at a second location configured to detect and measure the second magnetic field at the second location of the frame.

In another general respect, the embodiments disclose a method for determining a position of a plunger in a magnetically latching solenoid. The method includes producing, by at least one magnet, a magnetic field through a plunger and a frame of a magnetically latching solenoid; detecting and measuring, at least one sensor mounted on the frame, the magnetic field at a selected location on the frame; and determining, by a processor operably connected to the sensor, the location of the plunger based upon the magnetic field detected and measured by the at least one sensor.

BRIEF DESCRIPTION OF THE DRAWINGS

Aspects, features, benefits and advantages of the present invention will be apparent with regard to the following description and accompanying drawings, of which.

DETAILED DESCRIPTION

Figure 1:
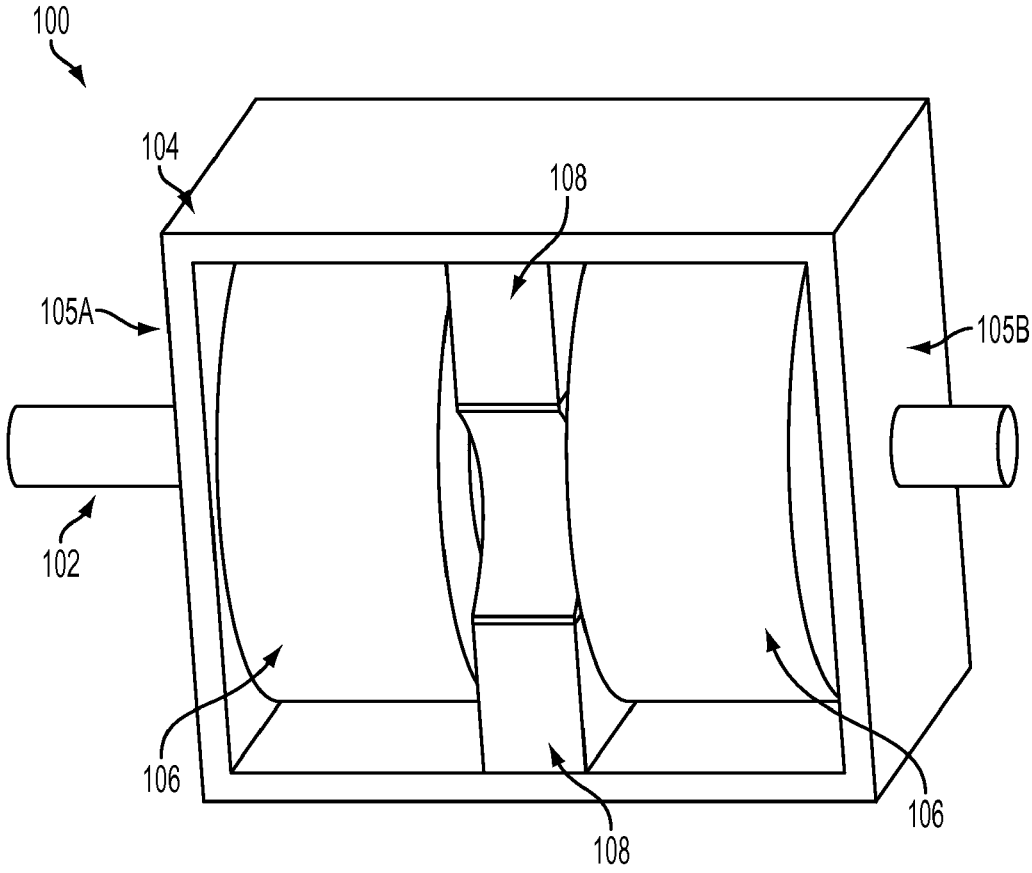
FIG. 1 PRIOR ART
FIG. 1 illustrates various embodiments of a magnetically latching solenoid.
Figure 2A:
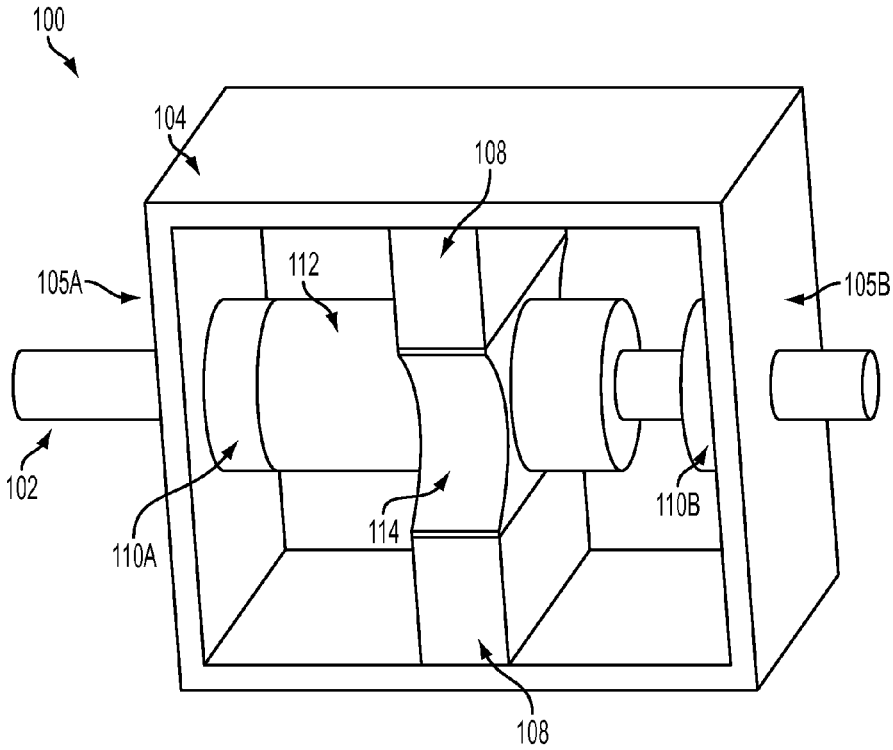
FIG. 2A PRIOR ART
FIGS. 2A and 2B illustrate various embodiments of a magnetically latching solenoid.
Figure 2B:
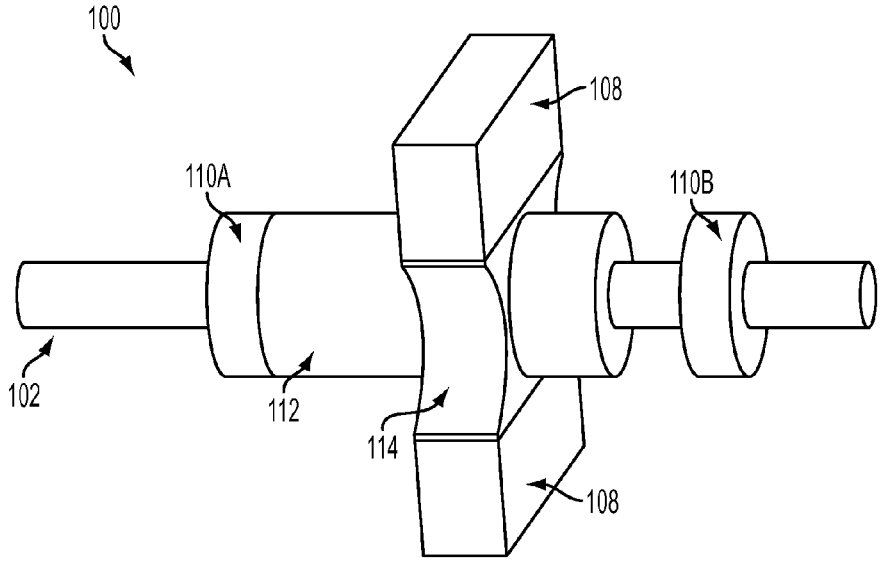
FIG. 2B PRIOR ART
Figure 3:
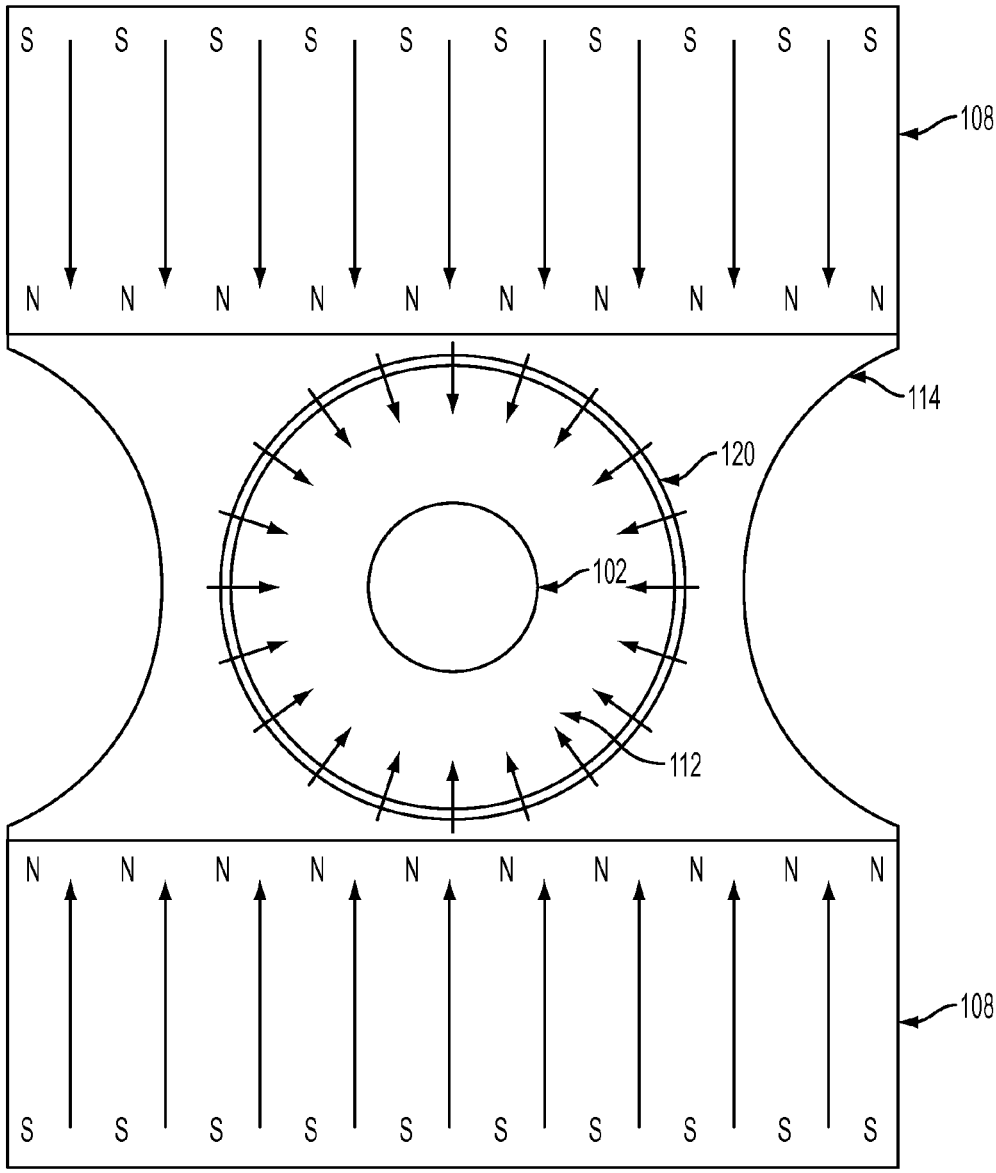
FIG. 3 PRIOR ART
FIG. 3 illustrates various embodiments of a permanent magnet structure for use in a magnetically latching solenoid.
Figure 3A:
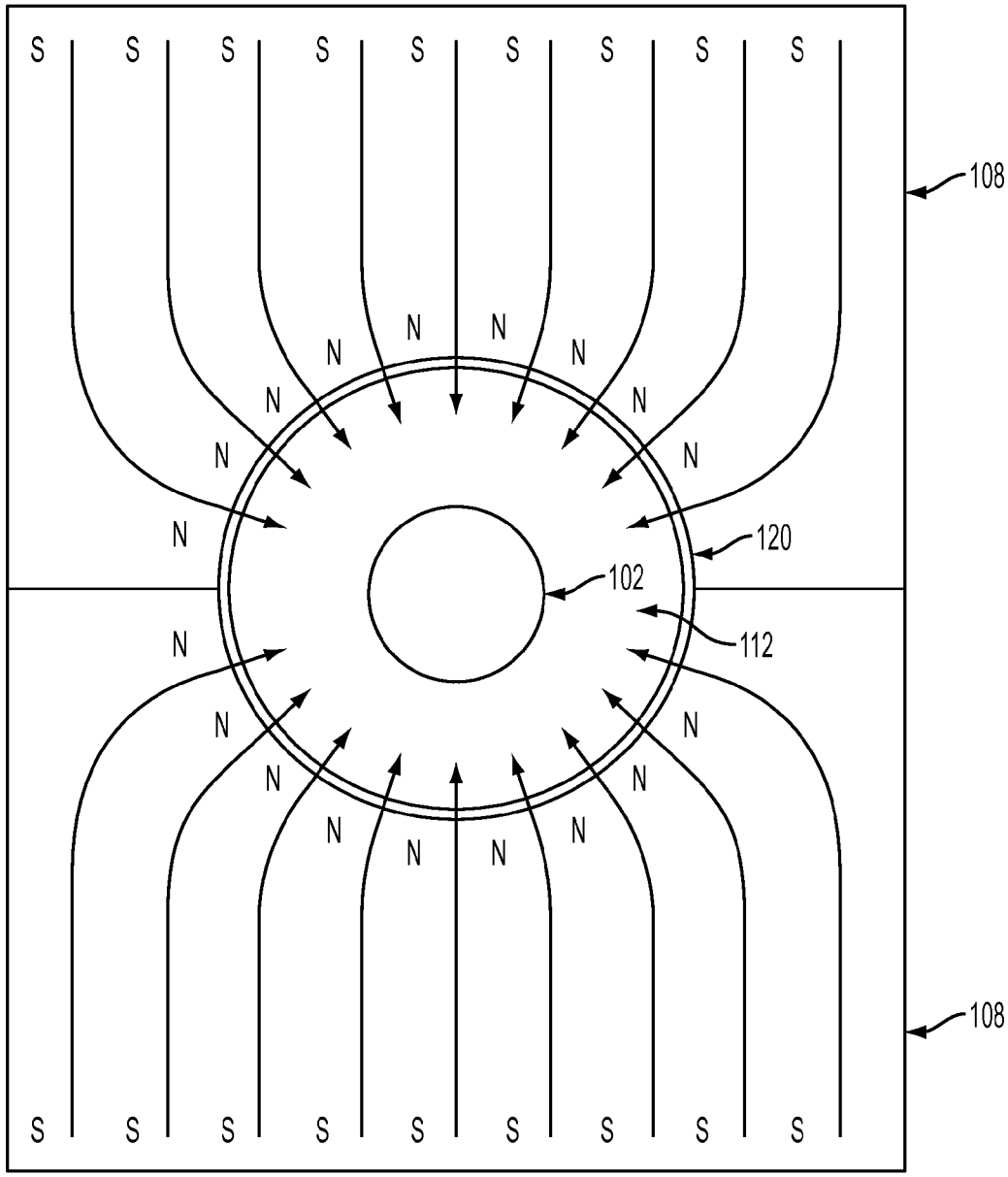
FIG. 3A PRIOR ART
FIG. 3A illustrates various embodiments of an alternative permanent magnet structure for use in a magnetically latching solenoid.

In one embodiment of solenoid 100, such as is discussed above, the flux density inside the magnets 108 may be about 1.2 Tesla, if, for example, the magnet material is Neodymium-Iron-Boron. In such a case, the flux density inside the portion of the plunger 112 to one side of the magnets may be saturated at about 2.0 Tesla. This difference in flux densities may be due to the relative difference in total cross-sectional areas of the magnets 108 and the plunger 112. The reason only a portion of the plunger has a high flux density is because most of the magnetic flux tends to follow the path of least reluctance, which is the path that includes the largest portion in steel and the least portion in air. In FIG. 2A the path of least reluctance is toward the left side 105A of frame 104 when the plunger is positioned as shown, because the air gap (if any) between the plunger 112 and the left anvil 110A is small as compared to the air gap between the plunger and the right anvil 110B. The magnetic flux tends to avoid paths of high reluctance, such as the path which crosses the larger air gap between the plunger 112 and the right anvil 110B, as can be seen in FIG. 2B.

The flux density in the left side 105A of frame 104 may also be saturated at about 2.0 Tesla, provided the frame has a similar total cross-sectional area to the plunger 112, and is made from a similar material (in this example steel). The saturation may also be due to the closeness of the plunger 112 to the left anvil 110A. The flux density in the portions of the plunger 112 and of the right side 105B of frame 104 to the right of the magnets 108 may be much less than saturation due to the larger air gap between the plunger and the right anvil 110B, causing a path of high reluctance.

If the plunger 112 was at the right end of its stroke in FIG. 2A, the flux densities discussed above would essentially be reversed, the flux density of the right end of the plunger and the right side 105B of frame 104 may be saturated, while the left end of the plunger and the left side 105A of the frame may be much less than saturation.

Figure 4:
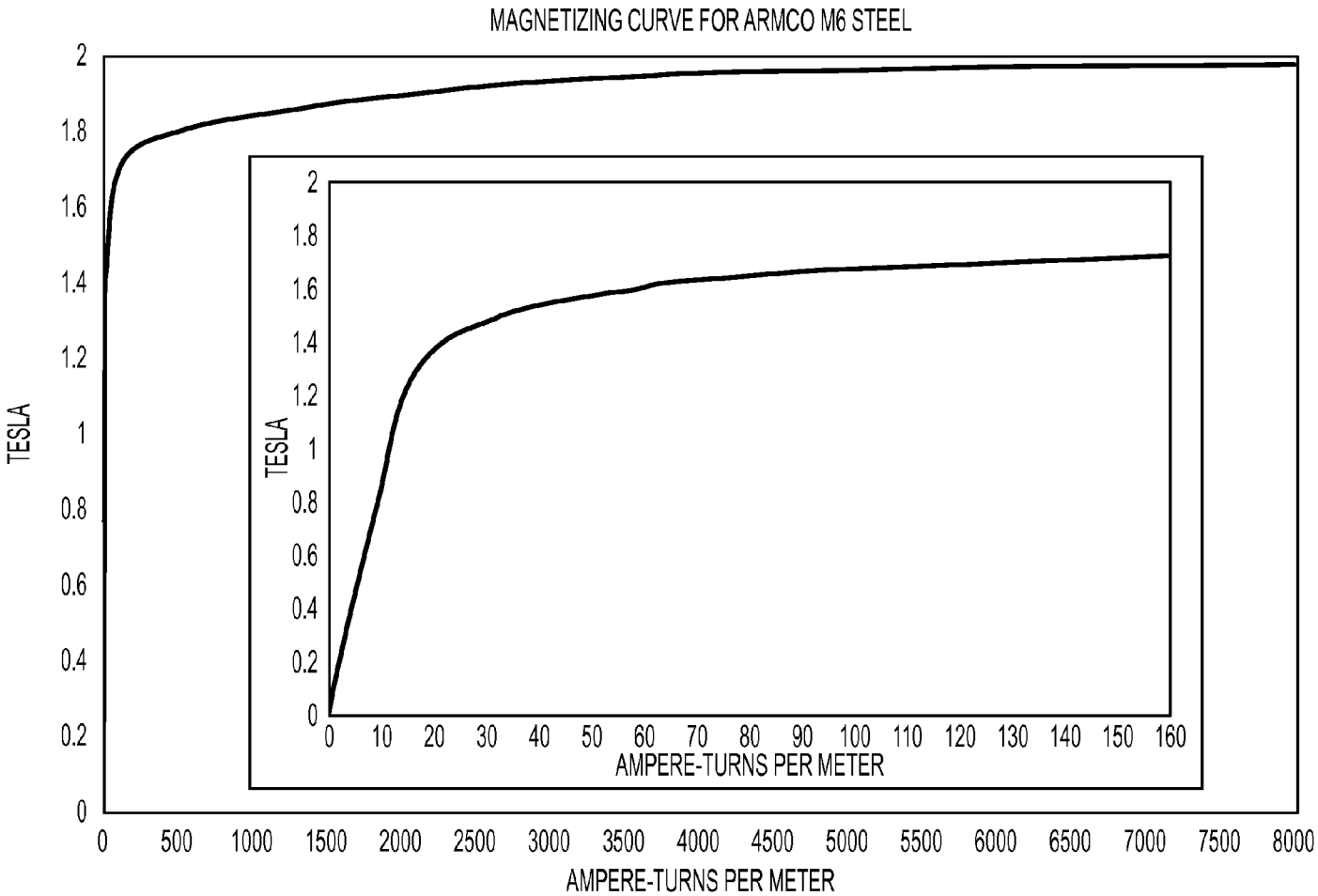
FIG. 4 PRIOR ART
FIG. 4 illustrates an exemplary magnetizing curve for steel.

FIG. 4 shows an exemplary magnetization curve for a type of steel, in this example Armco M6 steel. The X-axis is the Magneto-Motive Force (hereafter MMF) in amp-turns per meter and the Y-axis is the magnetic field strength in Tesla. The inset shows an expanded view of the first 2% of the main chart.

The magnetization curve is extremely non-linear. Note that to achieve a magnetic flux density of 0.5 Tesla, an MMF of only 6 amp-turns per meter may be required. To achieve a magnetic flux density of 1.7 Tesla, an MMF of 110 amp-turns per meter may be required. To achieve a magnetic flux density of 1.9 Tesla, an MMF of 2000 amp-turns per meter may be required.

Stated differently, a span of steel one inch long (0.0254 meters) containing a magnetic flux density of 0.5 Tesla may represent 0.1524 amp-turns of effective MMF, but the same span of steel containing a magnetic flux density of 1.9 Tesla may represent 50.8 amp-turns of effective MMF. These magnetic field values are typical of the right and left sides respectively of the frame 102 as discussed above.

The embodiments described in this document use the difference in effective MMF between steel at differing flux densities (such as 0.5 Tesla vs. 1.9 Tesla) to detect the position of the plunger 112 in a magnetically-latching solenoid such as solenoid 100. If the effective MMF is included within a closed secondary path of steel containing a small air gap, the included MMF may create a secondary magnetic field in the air gap. The strength of the secondary magnetic field may be measured to determine whether a portion (e.g., side 105A or 105B) of steel frame 104 is saturated or not, which may provide an indication of the position of the plunger 112.

Figure 5:
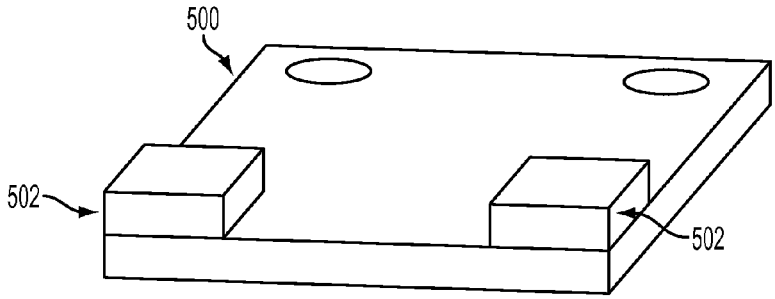
FIG. 5 illustrates various embodiments of an exemplary circuit board for use with a magnetically latching solenoid.
Figure 5A:
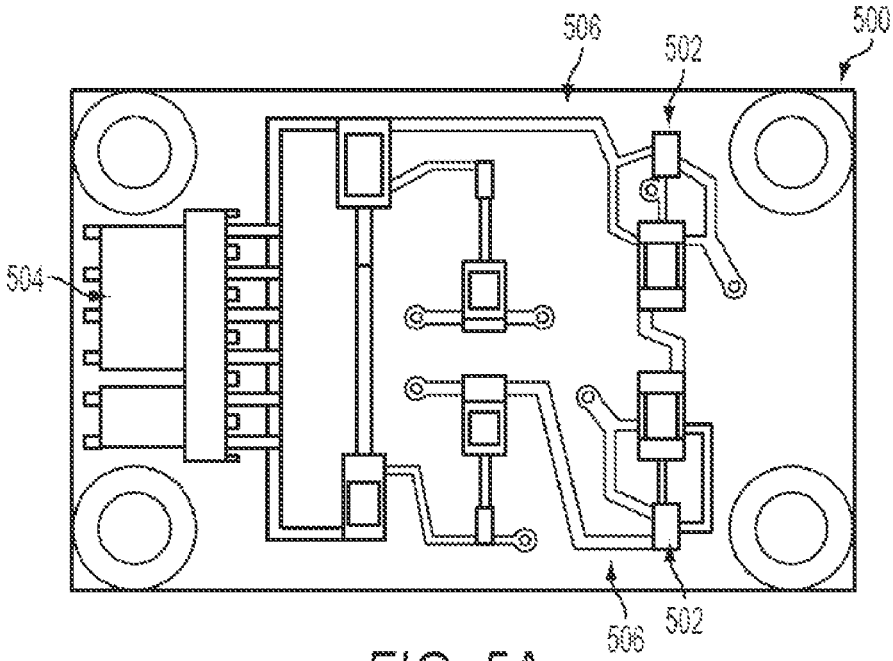
FIG. 5A illustrates various embodiments of the exemplary circuit board of FIG. 5.

FIGS. 5 and 5A illustrate an exemplary circuit board (CB) 500. CB 500 may be designed to include two Hall Effect sensors 502 mounted near two corners of the CB, represented by small boxes. Hall Effect sensors are specialized integrated circuits which respond to the presence of a magnetic field. One example of a Hall Effect sensor is a Binary Hall Effect sensor. A Binary Hall Effect sensor produces a digital signal indicating whether a detected magnetic field is above or below a threshold value. Another example of a Hall Effect sensor is a Linear Hall Effect sensor. A Linear Hall Effect sensor produces an analog signal proportional to the strength of a detected magnetic field. Any other device which responds to a magnetic field may be used, but Hall Effect sensors are mass-produced by many suppliers and are therefore very inexpensive. As shown in FIG. 5A, CB 500 may also contain a connector 504 to receive power from and to return signals to other remote circuits. There may also be conductive traces 506 on CB 500 which connect the Hall Effect sensors 502 to the connector.

Figure 6:
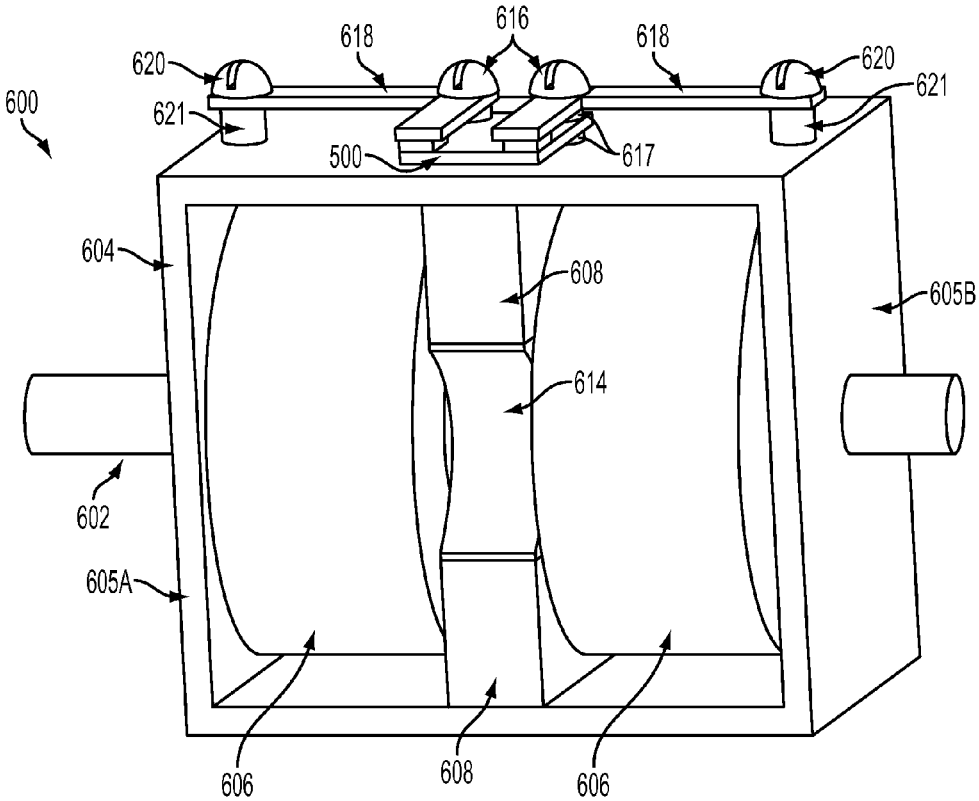
FIG. 6 illustrates various embodiments of a magnetically latching solenoid having the exemplary circuit board of FIG. 5.

By positioning CB 500 in a location on a magnetically latching solenoid where any magnetic saturation in the frame of the solenoid may be detected by the Hall Effect sensors 502 on the CB, the position of the plunger of the solenoid may be determined. FIG. 6 illustrates one exemplary magnetic latching solenoid 600 with CB 500 attached to detect magnetic flux densities that may be used to determine plunger location.

Solenoid 600 includes similar components to solenoid 100 discussed above. Shaft 602 may pass through frame 604 and may include a plunger (not visible in FIG. 6). It should be noted that frame 604 may be made from a magnetic material, such as steel. Frame 604 may include two anvils (not visible) constructed from a magnetic material such as steel. Coils 606 may be placed around the plunger on shaft 602. A permanent magnet structure may also be attached to frame 604 and may include magnets 608 and coupler 614.

Figure 6A:
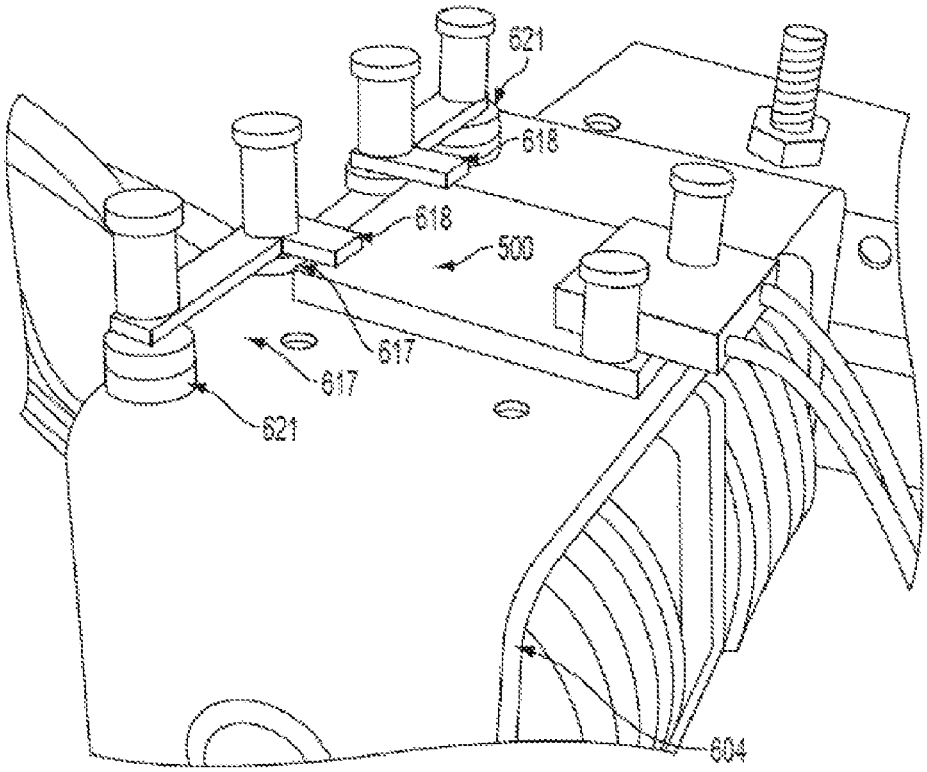
FIG. 6A illustrates various embodiments of a magnetically latching solenoid having the exemplary circuit board of FIG. 5A.

CB 500 may be mounted parallel to and close to the upper (or, conversely, lower) surface of the frame 604 of solenoid 600, near the center, and secured by non-magnetic (for example brass) fasteners such as screws 616 and spacers 617. In addition, the same non-magnetic screws 616 may secure one or more magnetic brackets 618 above CB. The magnetic brackets 618, which may be L-shaped (as shown) or of another suitable shape, may extend left and right nearly to the sides 605A and 605B of the frame 604, where they are further secured by magnetic (for example steel) fasteners, such as screws 620 and spacers 621. For example, magnetic brackets 618 may be a ferro-magnetic bracket positioned such that any magnetic field produced by the magnets 608 may be conducted to the CB 500. FIG. 6A illustrates an alternative exemplary embodiment of solenoid 600 having the embodiment of CB 500 as described in FIG. 5A, as well as showing alternative configurations for spacers 617, magnetic brackets 618 and spacers 621.

Figure 7:
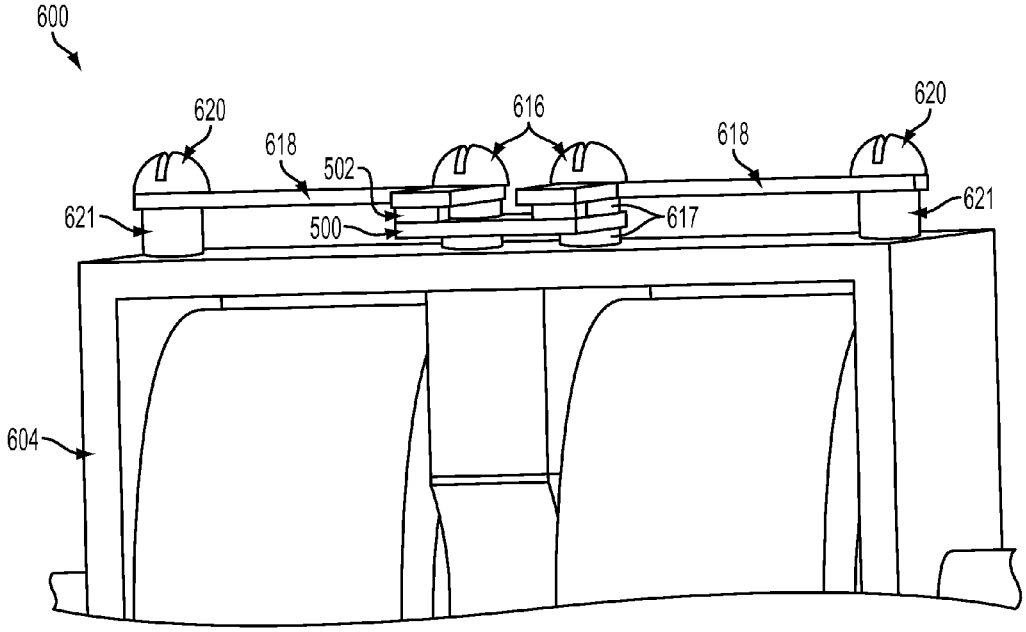
FIG. 7 illustrates additional various embodiments of a magnetically latching solenoid having the exemplary circuit board of FIG. 5.

FIG. 7 shows a close-up view of the configuration of magnetic brackets 618 and the CB 500 with the Hall Effect sensors 502. Each magnetic bracket 618 may be attached to the frame 604 in two locations. The first location may be near the center of the frame 604. In this first location, CB 500 is also attached with non-magnetic screws 616 and spacers 617. The second location where each magnetic bracket 618 may be attached is near the outside edge of frame 604. Here, magnetic screws 620 and spacers 621 may be used. By using magnetic screws 620 and spacers 621, any MMF due to saturation present in the outer portions of frame 604 may be conducted though each magnetic bracket 618 to the air gap containing the Hall Effect sensors 502 where any MMF will create a magnetic flux through the air gap and hence through the sensor. Non-magnetic screws 616 and spacers 617 may be used near the Hall Effect sensors to avoid diverting any magnetic flux away from the sensors.

It should be noted that the Hall Effect sensors 502 may be positioned directly between the short arms of the magnetic brackets 618 and the center portion of the steel frame 604 of solenoid 600. Any MMF that may be included in the loop formed by one of the magnetic brackets and the frame may result in a magnetic field across the air gap between the end of the magnetic bracket 618 over the Hall Effect sensor and the steel frame 604, and part of this magnetic field may pass through the corresponding Hall Effect sensor. By measuring this magnetic field passing through each of the Hall Effect sensors 502, and comparing the measured values against expect results based upon the magnetic potential of magnets 608 and the material used to construct frame 604, the position of the plunger of solenoid 600 may be determined. The strength of the magnetic field, for a given MMF, may be controlled to a limited extent by adjusting the height of the spacers, so as to match the sensitivity of the Hall Effect sensors 502.

In an exemplary embodiment, a processor or computing device may be operably connected to the PCB 500 via the connector 504 such that any magnetic field values detected or measured by sensors 502 may be transferred and processed to determine the position of the plunger in the solenoid. The processor or computing device may be operably connected to a computer readable storage device which may include various software and/or algorithms for determining the position of the plunger based upon the detected and measured values of the magnetic field.

Figure 8:
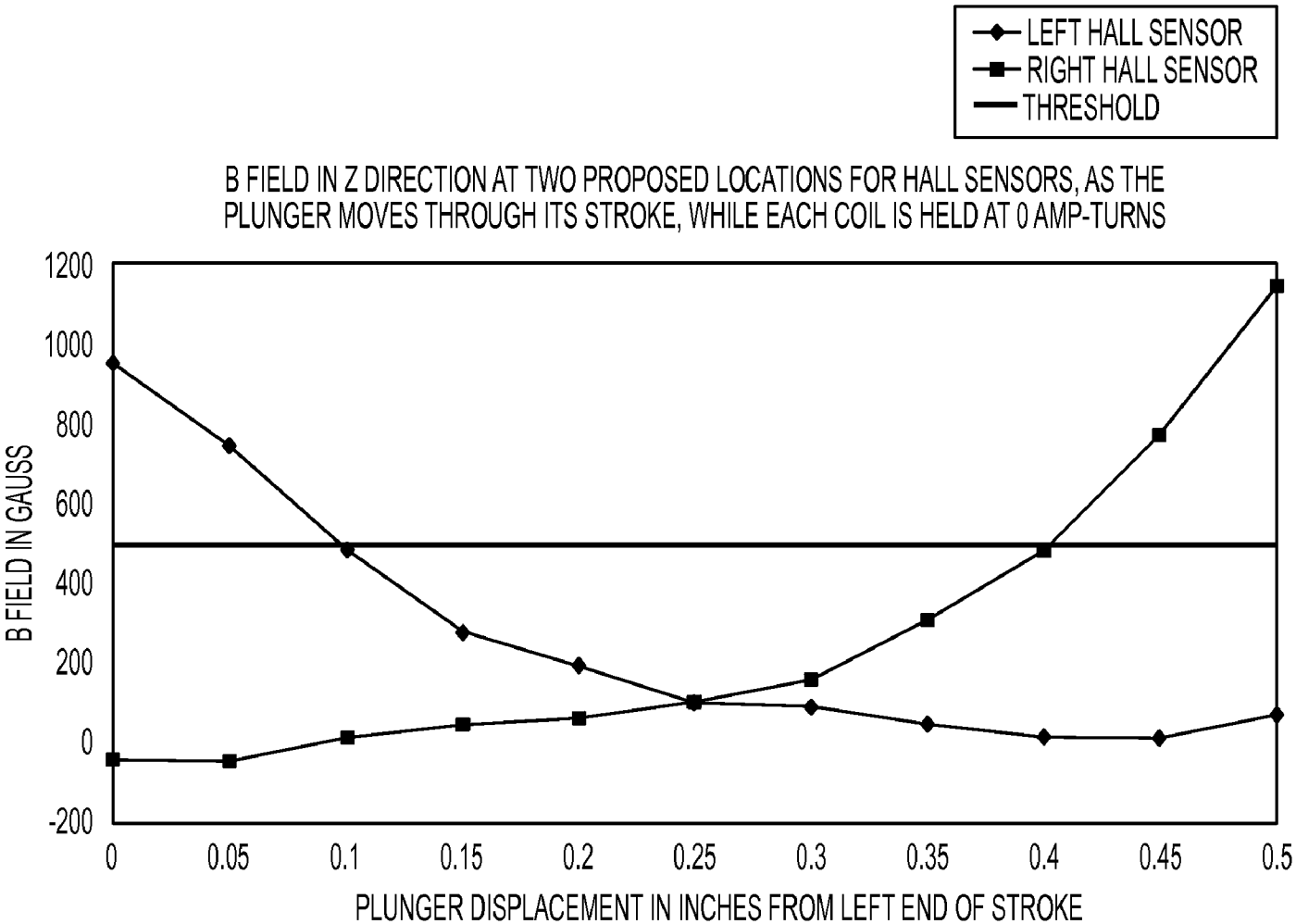
FIG. 8 illustrates an exemplary chart illustrating magnetic fields produced during a stroke of a solenoid plunger.

FIG. 8 illustrates an exemplary chart wherein a plunger of a magnetically latching solenoid is moved through its stroke from left to right, and the corresponding magnetic fields are measured at the locations of Hall Effect sensors mounted similar to those described in FIGS. 6 and 7.

FIG. 8 illustrates that when the plunger is at the left end of its stroke (the left side of the chart), the magnetic field through the left Hall Effect sensor may have a value of approximately 956 Gauss (0.0956 Tesla), while the magnetic field through the right magnetic field Hall Effect sensor may have a value of approximately −38 Gauss. When the plunger moves 0.1 inch toward the right, the magnetic field through the left Hall Effect sensor may decrease rapidly to approximately 488 Gauss while the magnetic field through the right Hall Effect sensor may increase slightly to approximately 14 Gauss. When the plunger reaches the mid-point of its stroke, the magnetic fields through both Hall Effect sensors may have about the same value of approximately 104 Gauss. When the plunger has moved 0.4 inch, such that it is 0.1 inch from the right end of its stroke, the magnetic field through the left magnetic field sensor may decrease to approximately 15 gauss while the magnetic field through the right magnetic field sensor may increase to approximately 488 Gauss. Finally, when the plunger is at the right end of its stroke, the magnetic field through the left magnetic field sensor may have a value of approximately 69 gauss while the magnetic field through the right magnetic field sensor may have a value of approximately 1143 Gauss. It should be noted that the field strength through the left sensor while at left stroke may differ slightly from the field through the right sensor at right stroke due to unavoidable manufacturing deviations and tolerances.

A straight horizontal line has been added to the chart shown in FIG. 8 representing a possible threshold value of 500 Gauss for a pair of Binary Hall Effect sensors. If the magnetic field strength in the left magnetic field sensors were compared to this threshold value, a signal may be generated that indicates when the plunger has moved within 0.1 inch of the left end of its stroke. If the magnetic field strength in the right magnetic field sensors were compared to this threshold value, a signal may be generated that indicates when the plunger has moved within 0.1 inch of the right end of its stroke. If neither signal was present, it may indicate that the plunger was in the middle portion of its stroke, more than 0.1 inches from either end. In many applications, this would indicate a fault condition in which the movement of the plunger had become blocked or jammed. Thus the position sensing system for a magnetically latching solenoid according to this disclosure may be capable of detecting a mechanical failure.

If Linear Hall Effect sensors are used to obtain the position information, the information may be passed to a general purpose computer. The general purpose computer may have software installed that receives this information from the Hall Effect sensors and calculates the position of the plunger. This calculation may be based upon several known factors such as the type of material (e.g., Armco M6 steel) used to manufacture the plunger, the frame, and the brackets; the associated magnetic curve (such as that shown in FIG. 4) for the materials used in the manufacturing process; the strength of the permanent magnets; the strength and accuracy ratings for the Hall Effect sensors; the distance of the stroke of the plunger; and any other relevant information that may factor in to any calculations performed by the software on the general purpose computer.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A magnetically latching solenoid comprising:

a frame;

a plunger configured to move through the frame between a first stable position at a first end of the frame and a second stable position at a second end of the frame;

at least one magnet centrally mounted within the frame and configured to produce a magnetic field through the plunger and the frame, wherein the magnetic field varies throughout the frame based upon the position of the plunger;

at least one sensor mounted to the frame configured to detect and measure the magnetic field at a selected location on the frame, wherein the magnetic field is stronger at the first end of the frame if the plunger is in the first stable position and the magnetic field is stronger at the second end of the frame if the plunger is in the second stable position; and at least one ferro-magnetic bracket configured to conduct the magnetic field to the at least one sensor, wherein the at least one ferro-magnetic bracket is configured to create an air gap in which the sensor is positioned and is further configured to allow changing a span of the air gap to adjust the sensitivity of the sensor.

2. The magnetically latching solenoid of claim 1, wherein the sensor is further configured to measure the magnetic field to determine whether the plunger is near one of the stable positions.

3. The magnetically latching solenoid of claim 1, wherein the sensor is positioned such that the magnetic field to be measured is obtained from a portion of the frame which saturates magnetically as the plunger nears the first stable position or the second stable position.

4. The magnetically latching solenoid of claim 3, wherein the sensor is further configured to detect the magnetic field increasing rapidly due to the saturation of the frame, thereby improving the sensitivity of the sensor to the position of the plunger.

5. The magnetically latching solenoid of claim 1, wherein the sensor comprises a Hall Effect sensor.

6. A magnetically latching solenoid comprising:

a frame;

a plunger configured to move through the frame between a first stable position at a first end of the frame and a second stable position at a second end of the frame;

at least one magnet centrally mounted within the frame such that a first magnetic field and a second magnetic field are produced by the magnet through the frame and the plunger, wherein each of the first and second magnetic fields drive a separate portion of the frame into magnetic saturation depending on the position of the plunger;

a first sensor mounted on the frame at a first location configured to detect and measure the first magnetic field at the first location of the frame; and a second sensor mounted on the frame at a second location configured to detect and measure the second magnetic field at the second location of the frame; and at least one ferro-magnetic bracket configured to conduct the magnetic field to at least one of the first sensor or the second sensor, wherein the at least one ferro-magnetic bracket is configured to create an air gap in which the sensor is positioned and is further configured to allow changing a span of the air gap to adjust the sensitivity of the sensor.

7. The magnetically latching solenoid of claim 6; wherein the first sensor is configured to measure the first magnetic field to determine whether the plunger is near the first stable position, and the second sensor is configured to measure the second magnetic field to determine whether the plunger is near the second stable position.

8. The magnetically latching solenoid of claim 6; wherein the magnet is positioned on the frame such that the two magnetic fields produced by the magnet travel in opposite directions through the plunger.

9. The magnetically latching solenoid of claim 6; wherein the first and second sensors comprise a Hall Effect sensor.

10. A method for determining a position of a plunger in a magnetically latching solenoid, the method comprising:

producing, by at least one magnet centrally mounted within the frame, a magnetic field through a plunger and a frame of a magnetically latching solenoid;

detecting and measuring, at least one sensor mounted on the frame, the magnetic field at a selected location on the frame, wherein the magnetic field is stronger at a first end of the frame if the plunger is in a first stable position and the magnetic field is stronger at a second end of the frame if the plunger is in a second stable position;

mounting at least one ferro-magnetic bracket on the frame configured to conduct the magnetic field to the at least one sensor;

creating an air gap between the bracket and the frame in which the at least one sensor is positioned; and determining, by a processor operably connected to the sensor, the location of the plunger based upon the magnetic field detected and measured by the at least one sensor.

11. The method of claim 10, wherein the sensor comprises a Hall Effect sensor.

* * * * *